US006720733B2

(12) United States Patent
Suzuki et al.

(10) Patent No.: US 6,720,733 B2
(45) Date of Patent: Apr. 13, 2004

(54) ELECTRODELESS LAMP SYSTEM

(75) Inventors: Akio Suzuki, Tokyo (JP); Takeshi Tada, Tokyo (JP); Taisei Kato, Tokyo (JP)

(73) Assignee: Orc Manufacturing Co., Ltd, Tokyo (JP)

( * ) Notice: Subject to any disclaimer, the term of this patent is extended or adjusted under 35 U.S.C. 154(b) by 0 days.

(21) Appl. No.: 10/225,533

(22) Filed: Aug. 22, 2002

(65) Prior Publication Data

US 2003/0042857 A1 Mar. 6, 2003

(30) Foreign Application Priority Data

Aug. 29, 2001 (JP) ..... 2001-259142

(51) Int. Cl.[7] ..... H01J 25/50; H05B 41/16

(52) U.S. Cl. ..... 315/39.51; 315/5.13; 315/248

(58) Field of Search ..... 315/248, 111.41, 315/DIG. 5, 111.21, 39.51, 5.31, 5.13; 219/678, 717, 721, 715; H05B 41/16; H01J 25/50

(56) References Cited

U.S. PATENT DOCUMENTS

| | | | | | |
|---|---|---|---|---|---|
| 3,774,054 | A | * | 11/1973 | Morse | 327/464 |
| 3,792,369 | A | * | 2/1974 | Levinson | 331/71 |
| 5,208,432 | A | * | 5/1993 | Han | 219/716 |
| 5,250,774 | A | * | 10/1993 | Lee | 219/760 |
| 5,283,410 | A | * | 2/1994 | Kim | 219/704 |
| 6,198,084 | B1 | * | 3/2001 | Kim | 219/703 |
| 6,449,178 | B1 | * | 9/2002 | Sakai et al. | 363/131 |
| 2003/0042857 | A1 | | 3/2003 | Suzuki et al. | 315/248 |

FOREIGN PATENT DOCUMENTS

| | | | | |
|---|---|---|---|---|
| JP | 2-276189 | | 11/1990 | H05B/6/68 |
| JP | 03257788 A | * | 11/1991 | H02M/3/28 |
| JP | 9-82112 | | 3/1997 | F21S/1/00 |
| JP | 2000-21559 | | 1/2000 | H05B/6/68 |

OTHER PUBLICATIONS

Magnetron Startup Current Profile of Fusion VPS/1600 UV Curing System (Exhibit 2).

VPS–6 Power Supply software, Version 25 of Oct. 9, 1996, of VPS/1600 UV Curing System (Exhibit 3).

Sales Order of Feb. 20, 1998 of VPS/1600 System and VPS–6 Power Supply (Exhibit 4).

F500S Installation, Operation, and Maintenance Manual (Exhibit 5).

Sales Order of Aug. 27, 2999 for Fusion F500S UV Curing System, including VPS–6 Power Supply (Exh. 6).

P6 "Soft Start" Graph (Exhibit 7).

* cited by examiner

*Primary Examiner*—Tan Ho
*Assistant Examiner*—Trinh Vo Dinh
(74) *Attorney, Agent, or Firm*—Liniak, Berenato & White

(57) ABSTRACT

An emission element enclosed inside an electrodeless lamp 5 is excited by an electromagnetic field of a microwave irradiated from a magnetron 2 for emitting light from the electrodeless lamp 5. A soft-starting method is provided such that an electric power enough to drive the magnetron 2 is gradually increased. The soft-starting method is to prevent the magnetron from being destroyed by self-heating due to a reflected wave of the microwave. The soft-staring method is used when a light begins to be emitted from the electrodeless lamp 5. Accordingly, the electrodeless lamp system is provided such that breakage of the magnetron caused by the self-heating due to the reflected wave of the microwave can be prevented.

11 Claims, 5 Drawing Sheets

TIME VARIATION OF IMPEDANCE IN THE ELECTRODELESS LAMP
(WHEN AN OPERATING POINT IS AT THE CENTER OF SMITH CHART,
THE REFLECTED WAVE IS NEVER GENERATED.)
FIG.6A (OPERATING POINT)
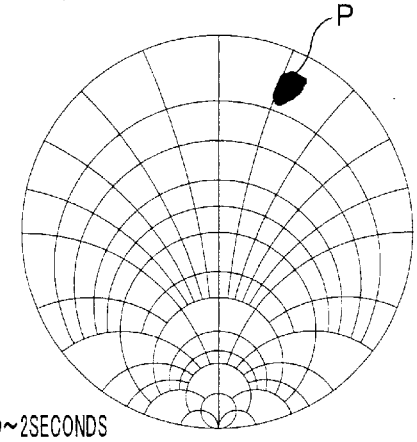
FIG.6D
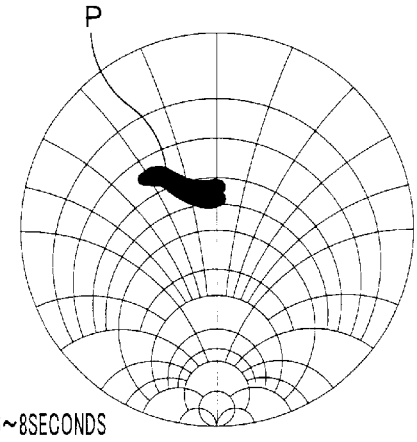
FIG.6B
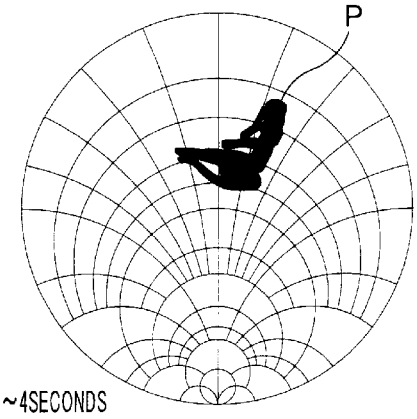
FIG.6E
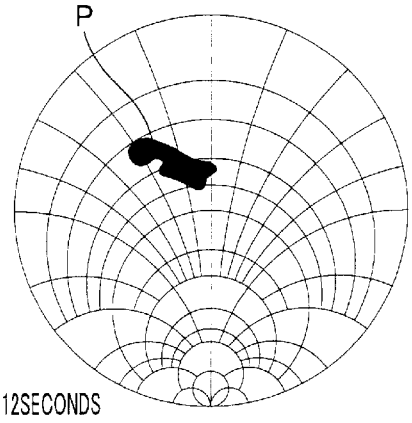
FIG.6C
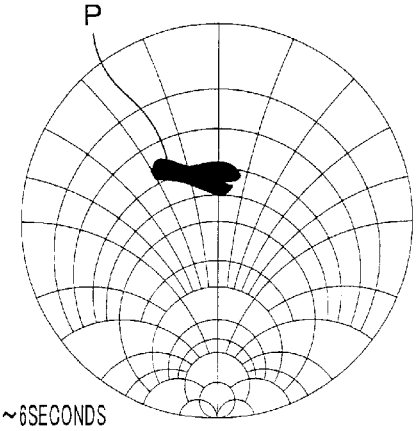
FIG.6F
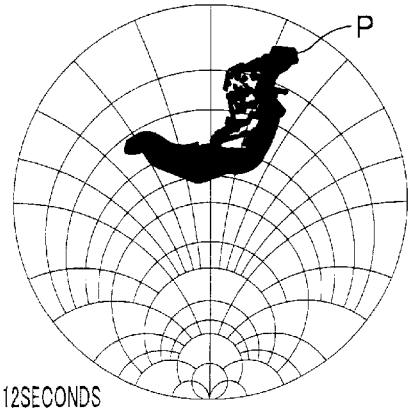
NOTE: THE LAMP IS LIGHTED IN APPROXIMATELY 5 SECONDS.

ELECTRODELESS LAMP SYSTEM

BACKGROUND OF THE INVENTION

1. Field of the Invention

The present invention relates to an electrodeless lamp system in which a microwave excites an electrodeless lamp for emitting light from the electrodeless lamp, more particularly, to an improved electrodeless lamp system for outputting high energy light from the electrodeless lamp.

2. Prior Art

An electrodeless lamp is lighted as follows. An emission element such as mercury or the like enclosed inside the lamp is excited by a microwave irradiated from a magnetron via an antenna for emitting the light from the lamp.

For example, microwave ovens used as common domestic articles have been known for heating objects such as frozen food or the like around 600 W by using the microwave irradiated from the magnetron. This type of the microwave oven will never be broken by self-heating of the magnetron since the microwave outputted from the magnetron is low energy.

However, when the microwave energy outputted from the magnetron is high energy, such as more than 6 KW (one side 3 KW×2), the following drawback will arise. As shown in FIG. 5, if electric power being supplied to the magnetron is a maximum output, namely, full power at the beginning of starting the lamp for lighting, the microwave is irradiated from the magnetron with maximum power before an emission element such as mercury or a halogen ferrite enclosed inside the lamp is completely vaporized.

FIGS. 6A through 6F each indicate a time-variation of impedance in the electrodeless lamp system respectively. FIG. 6A indicates a change of operating point P for a two-second period of the time (t=0 through 2) that has passed since starting. FIG. 6B indicates a change of operating point P for the next two-second period of the time (t=2 through 4) that has passed after the first two seconds had passed since starting. FIG. 6C indicates a change of operating point P for the next two-second period of the time (t=4 through 6) that has passed after four seconds had passed since starting. FIG. 6D indicates a change of operating point P for the next two-second period of the time (t=6 through 8) that has passed after six seconds had passed since starting. FIG. 6E indicates a change of operating point P for the next two-second period of the time (t=10 through 12) that has passed after ten seconds had passed since starting. FIG. 6F indicates a change of operating point P for the period of the time that 12 seconds (t=0 through 12) has passed since starting.

According to FIGS. 6A through 6F, the more an operating point P is away from a center of Smith chart, the more a reflected wave is generated. In the meantime, the more the operating point P approaches a center of Smith chart, the less the reflected wave is generated. Furthermore, when the operating point P is at the center of Smith chart, the reflected wave is never generated so that a process for lighting the lamp is completed. The case of FIGS. 6A through 6F shows that the lamp is lighted in 5 seconds.

Accordingly, when the emission element enclosed inside the lamp hardly absorbs the microwave irradiated from the magnetron, the microwave is not absorbed into the emission element and is returned to the magnetron as the reflected wave. Thereby, the magnetron is heated by itself due to the reflected wave. Consequently, any parts of inside the magnetron are melted, or a ceramic material covering around a magnetron output-antenna is cracked. These phenomena cause the magnetron to be destroyed.

Energy of the reflected microwave caused by emitting the light from the lamp has been recently increased due to increases in the energy of the light outputted from the electrodeless lamp, that is, electric power being inputted to the magnetron has been increased.

An isolator capable of easily eliminating the reflected wave can be used as a method to prevent a self-heating of the magnetron caused by the reflected wave. However, this solution increases the size of the electrodeless lamp system (lighting tool) and is expensive in price, etc., thus making the solution impractical.

First, there is provided a heat system including a conventional electrodeless lamp disclosed in the Japanese unexamined Patent Publication H09-82112. The heat system is operated in the following manner. A heater voltage is restricted to a lower value than standard value when lighting the lamp (when high voltage is applied) to shorten a warm-up time as much as possible for securing a stable operation when lighting the lamp.

Second, there is provided a heat system disclosed in the Japanese unexamined Patent Publication 2000-21559 operated in following manner. A predetermined value of initial current is set so as to be lower than a predetermined value of input current as a predetermined value of current flowing through a high-voltage power conversion part. The input current of the high-voltage power conversion part is controlled so as to be a predetermined value of initial current when heating operation is started. Then, the rated electric power is utilized to the utmost by restraining the overshoot of input current to reduce the heating time.

Third, there is provided a heat system disclosed in the Japanese unexamined Patent Publication H02-276189 operated in following manner. A voltage value generating in a high voltage circuit is restricted to around a value enough to be applied at the time of normal oscillation of the magnetron until the temperature of a cathode of the magnetron is raised enough to emit a sufficient quantity of electron for oscillation. At the same time, excessive voltage is not generated on the secondary side so that a magnetron is not oscillated even though the temperature of a cathode is raised. Accordingly, the generation of abnormally high voltage can be prevented until the starting of oscillation of the magnetron after the electronic power is applied. Consequently, breakage of high voltage parts and of a switching device can be prevented.

However, any inventions disclosed in each of the aforementioned unexamined patent publications are not to solve the drawback of the magnetron being destroyed by self-heating caused by the reflected wave.

Furthermore, as for the aforementioned phenomenon, a microwave irradiated from the magnetron is returned to the magnetron again as the reflected wave during the period of the moment from when the microwave begins to be irradiated from the magnetron to when the lamp is in a stable condition for lighting. This situation creates a large stress for the magnetron so as to be a large factor for shortening the life span of the magnetron.

A countermeasure against the aforementioned drawback is considered as follows. The microwave begins to be irradiated from the magnetron under the condition that low microwave energy is outputted from the magnetron. For example, an amount of energy sufficient to output the microwave from the magnetron is gradually increased to the maximum value of outputting condition during the period of time from approximately 5 to 20 seconds for lighting the lamp completely. Specifically, the stress applying to the magnetron caused by the reflected wave can be reduced by a soft-starting method. Accordingly, the life span of the magnetron can be expanded.

Therefore, the object of the present invention is to cope with aforementioned drawback for providing the electrodeless lamp system capable of preventing the magnetron from being broken by the self-heating caused by the reflected wave.

SUMMARY OF THE INVENTION

To attain aforementioned object, the electrodeless lamp system is comprised in following ways.

As a first aspect of the present invention, a soft-starting method is practiced on the electrodeless lamp system, wherein the electrodeless lamp is excited by an electromagnetic field of the microwave irradiated from the magnetron for emitting the light from the lamp. Herein, the soft-starting method gradually increases electric power enough to drive said magnetron and is used when the light begins to be emitted from the electrodeless lamp.

Accordingly, enough electric power to drive the magnetron can be gradually increased by using the soft-starting method when light begins to be emitted from the electrodeless lamp. Thereby, the electric power being supplied to the magnetron is increased when the emission element enclosed inside the lamp is vaporized. Consequently, the microwave can easily be absorbed into the emission element to reduce the generation of the reflected wave of the microwave, even though a high energy of microwave is outputted from the magnetron.

As a second aspect of the present invention, said soft-starting method according to first aspect of the present invention sets up its timing in the following way. An amount of time until energy of microwave irradiated from the magnetron reaches a maximum value is longer than the amount of time for the emission element in the electrodeless lamp to absorb the microwave and vaporize.

Accordingly, when electric power being supplied to the magnetron reaches a maximum value, the emission element is already vaporized completely. For example, if the amount of time until energy of the microwave irradiated from the magnetron reaches a maximum value is set as approximately 5 through 20 seconds, the lamp is appropriately and perfectly lighted.

As a third aspect of the present invention, a luminous flux density-detecting method is provided during an operation of the operation of the soft-starting method according to the first or second aspect of the present invention. Said detecting method is to detect a luminous flux density of the light irradiated from the electrodeless lamp for controlling an increase of the electric power for being inputted to the magnetron in following ways.

When the light of the luminous flux density detected by the luminous flux density-detecting method is less than a predetermined value, the increase of the electric power for being inputted to the magnetron is stopped for maintaining a waiting condition. On the other hand, when the luminous flux density reaches the predetermined value, the increase of the electric power for being inputted to the magnetron is restarted.

Accordingly, the reflected wave of the microwave can be securely reduced, such that a breakage of the magnetron can securely be prevented.

BRIEF DESCRIPTION OF THE DRAWINGS

FIGS. 6A through 6F are explanatory diagrams showing a time variation with regard to an impedance of the electrodeless lamp.

DESCRIPTION OF THE PREFERRED EMBODIMENTS

The embodiment of the present invention will be now explained in detail in accordance with drawings.

Figure 1:
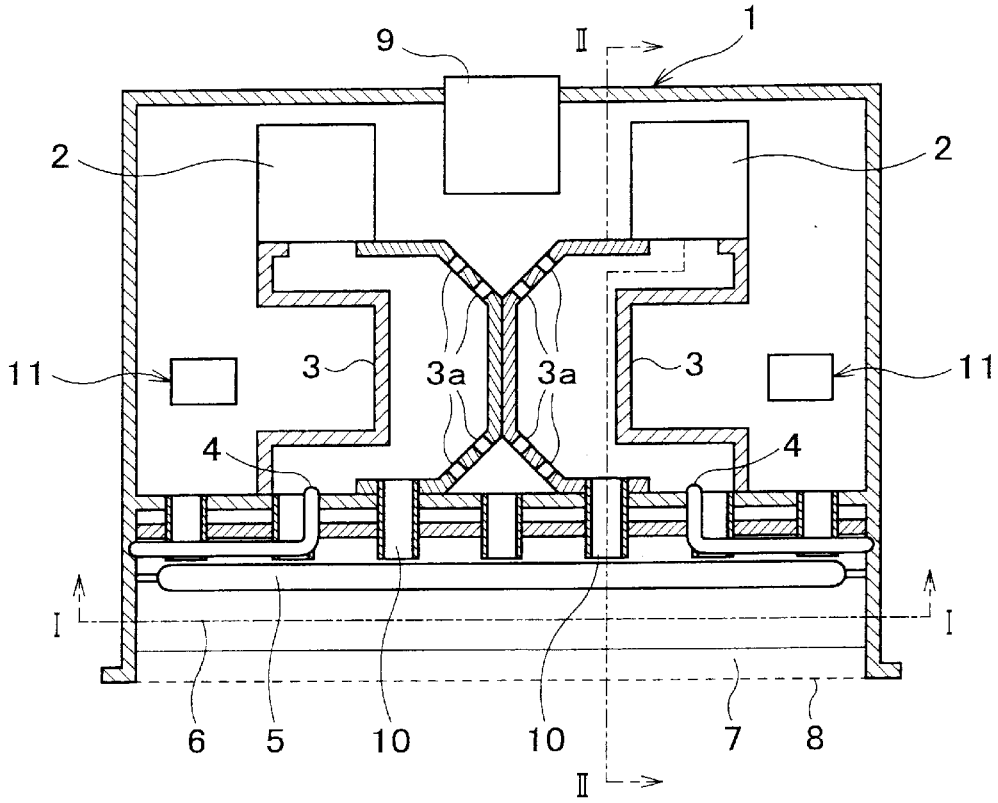
FIG. 1 is a schematic cross-sectional view of a lighting tool, wherein an electrodeless lamp system with regard to the present invention has been applied to the lighting tool.
Figure 2:
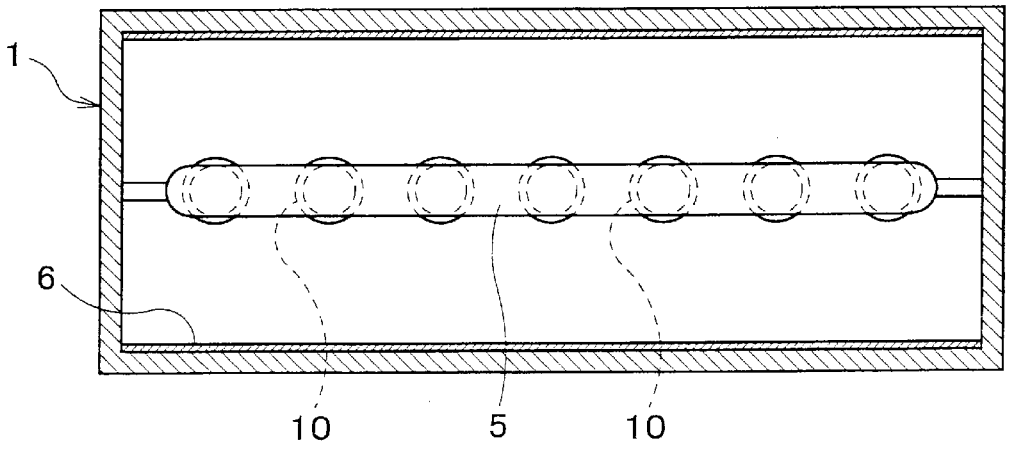
FIG. 2 is a schematic cross-sectional view of the electrodeless lamp shown in FIG. 1 taken along section of arrow line I—I.
Figure 3:
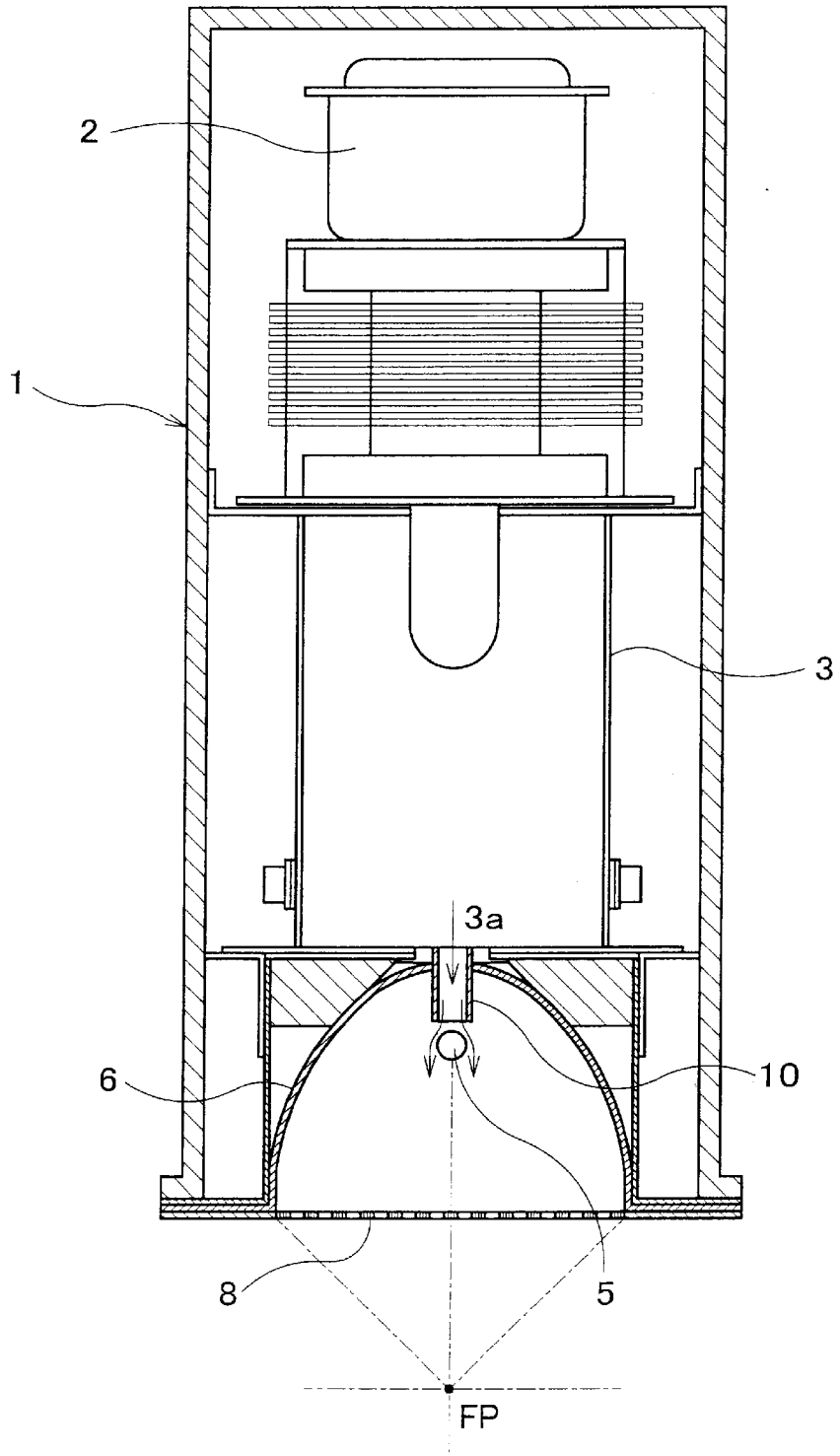
FIG. 3 is a partial enlarged cross-sectional view of the electrodeless lamp shown in FIG. 1 taken along section of arrow line II—II.
Figure 4:
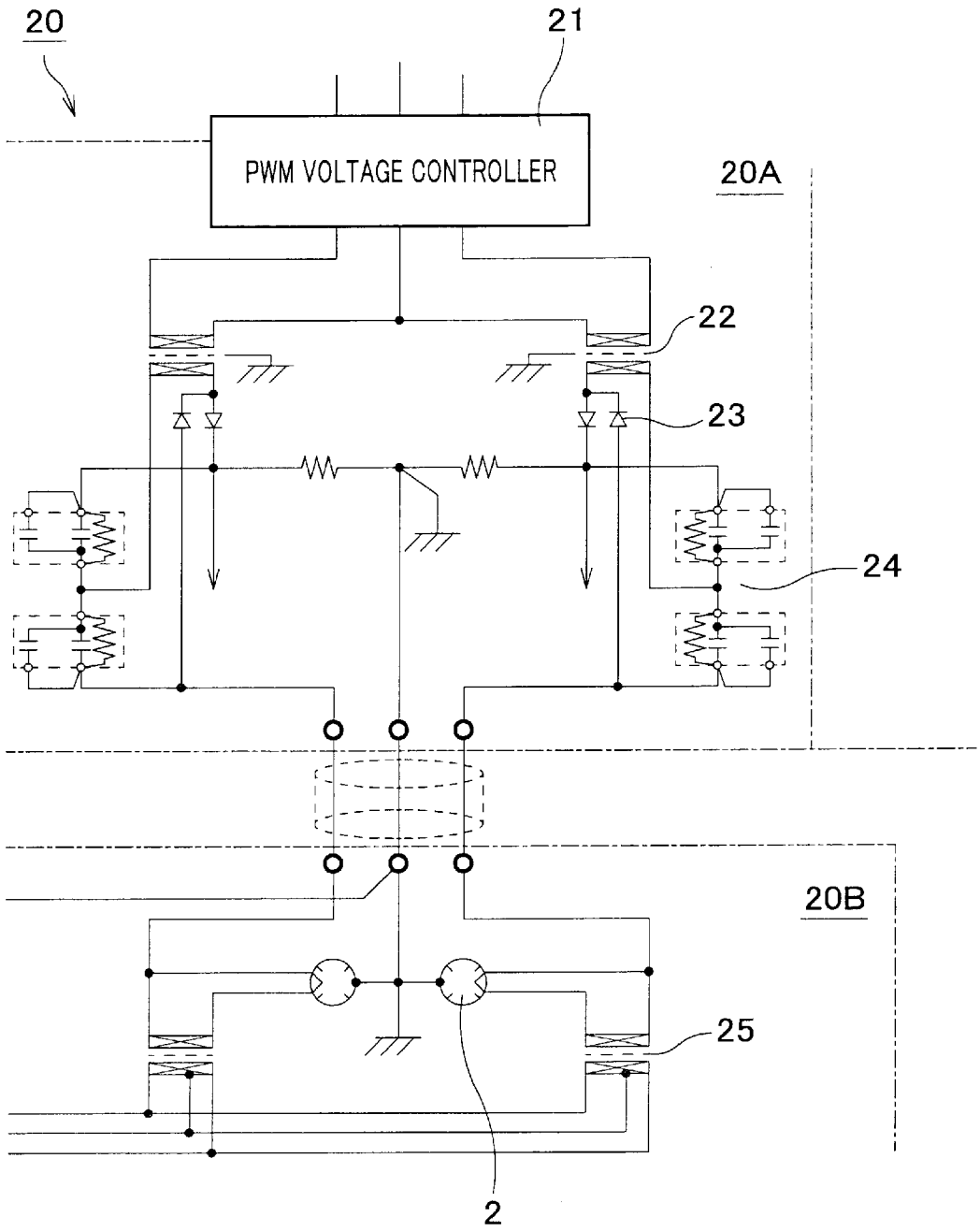
FIG. 4 is an explanatory diagram showing a control circuit for driving a magnetron.

FIG. 1 through FIG. 4 indicate one embodiment of an electrodeless lamp system with regard to the present invention. FIG. 1 is a schematic cross-sectional view of a lighting tool, wherein the electrodeless lamp system has been applied to the lighting tool. FIG. 2 is a schematic bottom view. FIG. 3 is a partial enlarged cross-sectional view of the electrodeless lamp. FIG. 4 is an explanatory diagram showing a control circuit for driving a magnetron.

As illustrating in FIG. 1 through FIG. 3, reference numerals 1 through 11 indicate following matters respectively. 1 shows a lighting tool box. 2 shows a magnetron to generate an electromagnetic field of a microwave. 3 shows a wave-guide. 4 shows-an antenna. 5 shows the electrodeless lamp. 6 shows a reflector. 7 shows a microwave-resonator. 8 shows a reflected microwave-mesh. 9 shows a cooling fun. 10 shows a lamp cooling nozzle. 11 shows a luminous flux density-detecting sensor.

Specifically, the electrodeless lamp system with regard to the present invention includes two magnetrons 2 in the lighting tool box 1. Herein, an oscillation frequency of said magnetron 2 is 2.45 GHz. The microwave emitted from these two magnetrons 2 is irradiated to the electrodeless lamp 5 via the guide-wave 3 and the antenna 4. At this moment, an emission element such as mercury enclosed inside the electrodeless lamp 5 absorbs the microwave, is vaporizes and excites the microwave for emitting the light from the electrodeless lamp 5. This is the state that the electrodeless lamp 5 is lighted. Then, the light emitted from the electrodeless lamp 5 is condensed outside by the reflector 6 so as to be connected to focus FP.

Additionally, the cooling fun 9 is to cool the magnetron 2. In the meantime, the wind blown by the cooling fun 9 cools the electrodeless lamp 5 via both a through hole 3*a* opened on the wave-guide 3 and a lamp cooling nozzle 10 as indicated with arrow marks of real line in FIG. 3.

Furthermore, the luminous flux density-detecting sensor 11 detects the luminous flux density of the light emitted from the electrodeless lamp 5, namely a gaseous condition of the emission element enclosed inside the electrodeless lamp 5 for controlling the magnetron-driver circuit 20 enough to drive the following magnetron (See FIG. 4).

Specifically, as shown in FIG. 4, the magnetron-driver circuit 20 consists of a power source 20A and a lighting tool 20B wherein the power source 20A and the lighting tool 20B are connected with each other by a high-voltage output and a high-voltage input. Herein, the power source 20A includes PWM voltage controller 21, a voltage transformer 22, a rectifier diode 23, and a voltage doubler-condenser 24. On the other hand, the lighting tool 20B includes a heater trance 25 to carry out a heat control of the magnetron 2.

The energy of the microwave outputted from the magnetron 2 is evaluated by multiplying an anode voltage and an anode current of the magnetron together. Herein the anode voltage of the magnetron is almost invariable. Accordingly, the energy of the microwave outputted from the magnetron 2 is determined by the magnitude of the anode current of the magnetron. Still more, the magnitude of the current of the magnetron is determined by a voltage of a primary side of the voltage transformer 22. On the other hand, the voltage of the primary side of the voltage transformer 22 is determined by PWM voltage controller 21.

As described above, the soft-starting method with regard to the present invention is constituted of PWM voltage controller 21 and the voltage transformer 22. The soft-starting method gradually increases the electric power enough to drive the magnetron 2 in such a manner that the primary side of voltage of the voltage transformer 22 is varied by PWM voltage controller 21 to vary a microwave output of the magnetron 2. Accordingly, the electric power for being supplied to the magnetron 2 is increased in accordance with the case that the emission element enclosed inside the electrodeless lamp 5 is vaporized. Consequently, the emission element can easily absorb the microwave such that generation of the reflected wave of the magnetron can be reduced even though a high energy microwave is outputted from the magnetron.

Additionally, there is provided magnetron 2 in the electrodeless lamp system with regard to the present invention. The magnetron 2 is used as an oscillation source of the microwave and is operated at an oscillation frequency of 2.45 GHz. Herein, the electrodeless lamp system of the present invention includes two magnetrons 2 so that a total energy of microwave is approximately 6 KW. Further, a full-wave voltage doubler circuit is used in the magnetron-driver circuit 20 to control a drive of the magnetron 2. At the same time, the soft-starting method is used such that the input voltage of the primary side of the voltage transformer 22 is controlled by PWM voltage controller 21. Consequently, the electric power enough to drive the magnetron 2 can be variable.

Figure 5:
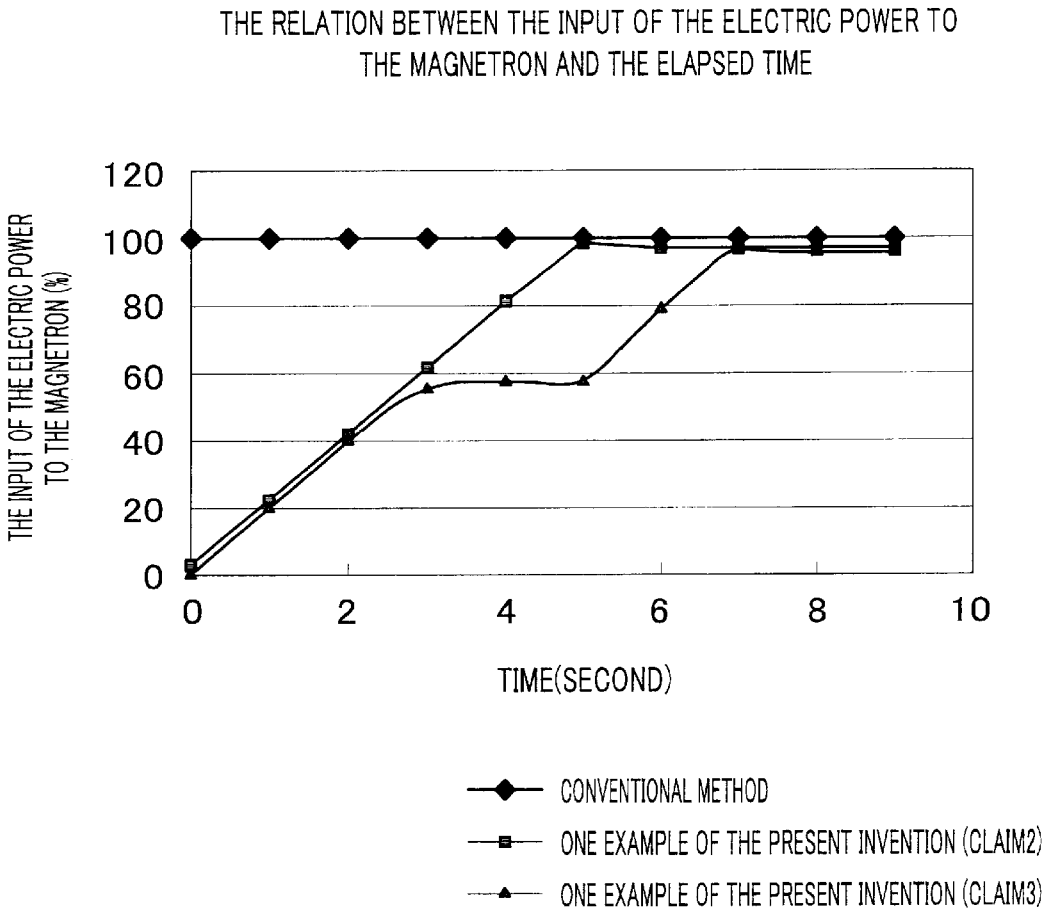
FIG. 5 is an explanatory graph showing the situation that the electric power is inputted to the magnetron as time elapses.

What is more, as shown in FIG. 5, the electric power for being supplied to the magnetron 2 is softly started by the soft the starting method such that the input voltage of the voltage transformer 22 is gradually increased from an initial output 0% (0V) to a maximum output (full power) 100% (200V) as time elapses after the light begins to be emitted from the lamp. In this case, the time until the electric power for being inputted to the magnetron 2 reaches a full power by the soft-starting method is set as 5 seconds.

Accordingly, energy of the microwave outputted from the magnetron 2 can be gradually increased from low energy to maximum energy during the period of the moment from when the microwave begins to be irradiated from the magnetron 2 to when the electrodeless lamp system 5 is in a stable condition for lighting. Consequently, the stress applied to the magnetron 2 caused by the reflected wave can be reduced.

For example, when the electric power being inputted to the magnetron 2 is 60% of full power, a luminous flux density of the light emitted from the electrodeless lamp 5, namely a gaseous condition of emission element enclosed inside the electrodeless lamp 5 is detected by a luminous flux density-detecting sensor 11. Herein, said detecting sensor 11 is installed in the electrodeless lamp system for judging whether the luminous flux density of the light is more than predetermined value or not.

At the same time, the increase of the electric power being inputted to the voltage transformer 22 is controlled by said detecting sensor 11 in following manners.

When a luminous flux density of the light emitted from the electrodeless lamp 5 is less than a predetermined value during the soft-starting operation, an increase of electric power being inputted to the voltage transformer 22 is stopped to wait until the light emitted from the electrodeless lamp 5 becomes said predetermined value. Sequentially when the luminous flux density of the light reaches more than predetermined value, the electric power for being inputted to the voltage transformer 22 is increased so as to gradually increase the electric power supplied to the magnetron 2.

On the other hand, when the lamp is lighted as conventional way such that the electric power is supplied to the magnetron with full power as soon as the lamp is lighted, the magnetron was broken after it is executed within 20 to 30 times. However, according to the present invention, self-heating of the magnetron caused by the reflected microwave can be preventable by using the soft-starting method so that the magnetron 2 will never be broken when the lamp begins to be lighted.

Still more, according to aforementioned embodiment of the present invention, the magnetron 2 is used as an oscillation source of the microwave and is operated at an oscillation frequency of 2.45 GHz. Two magnetrons 2 are used so that a total energy of microwave is approximately 6 KW. However exceptions can be made such that one or more than three magnetrons 2 can be used in the electrodeless lamp system.

Additionally, the full-wave voltage doubler circuit is used in the magnetron driver circuit 20 to control a drive of the magnetron 2. However, the present invention is not restricted to aforementioned manner. At the same time, it goes without saying that any changes can be made in various ways without departing from the spirit and scope of the invention.

As described above, the electrodeless lamp system with regard to the present invention exhibits excellent effects in following ways.

According to the first aspect of the present invention, the soft-starting method is used for gradually increasing the electric power from an amount enough to drive the magnetron upon vaporization of the emission element enclosed inside the electrodeless lamp 5. Thereby, the emission element can easily absorb the microwave for reducing the reflected wave of the microwave. Consequently, breakage of the magnetron caused by the self-heating as conventional drawback can be preventable.

According to the second aspect of the present invention, the soft-stating time until energy of microwave irradiated from the magnetron reaches a maximum value is set longer than the amount of time for the emission element in the electrodeless lamp to absorb the microwave and vaporize.

Accordingly, when electric power for being supplied to the magnetron reaches maximum value, emission element enclosed the lamp is sufficiently vaporized. Consequently, the emission element can easily absorb the microwave for securely reducing the reflected wave of the microwave.

According to the third aspect of the present invention, a luminous flux density-detecting method is provided during an operation of the soft-starting method to detect a luminous flux density of the light irradiated from the electrodeless lamp. The luminous flux density-detecting method controls the increase of electric power inputted to the magnetron in following ways.

When the luminous flux density detected by the luminous flux density-detecting method is less than a predetermined value, an increase of the electric power inputted to the magnetron is stopped for maintaining a waiting condition. On the other hand, when the luminous flux density reaches the predetermined value, the increase of the electric power for being inputted to the magnetron is restarted.

Accordingly, the reflected wave of the microwave can be securely reduced so that a breakage of the magnetron can securely be prevented.

What is claimed is:

1. A soft-starting method for operating an electrodeless lamp system, the electrodeless lamp system comprising a magnetron for irradiating an electromagnetic field of a microwave, and an electrodeless lamp excited by the electromagnetic field of the microwave irradiated from the magnetron for emitting light, the soft-starting method comprising:

supplying enough electric power to the magnetron to drive the magnetron;

gradually increasing the electric power when the light begins to be emitted from the electrodeless lamp; and setting up a time schedule in such manner that an amount of time until energy of the microwave irradiated from the magnetron reaches a maximum value is longer than an amount of time for an emission element in the electrodeless lamp to absorb the microwave and vaporize.

2. The soft-starting method as set forth in claim 1, further comprising conducting a luminous flux density-detecting method comprising:

detecting a luminous flux density of the light irradiated from the electrodeless lamp for controlling an increase of inputting the electric power to the magnetron, when the luminous flux density detected by the luminous flux density-detecting method is less than a predetermined value, stopping the increase of the electric power inputted to the magnetron for maintaining a waiting condition, and when the luminous flux density reaches the predetermined value, restarting the increase of the electric power inputted to the magnetron.

3. A soft-starting method for operating an electrodeless lamp system, the electrodeless lamp system comprising a magnetron and an electrodeless lamp, the electrodeless lamp comprising an emission element, said soft-starting method comprising:

applying a sufficient amount of electric power to the magnetron to drive the magnetron and irradiate a microwave comprising an electromagnetic field from the magnetron, the microwave having an energy less than a maximum value;

exciting the emission element of the electrodeless lamp with the electromagnetic field, said exciting comprising absorbing the microwave and vaporizing the emission element to start the emission of light from the electrodeless lamp; and after the emission of light from the electrodeless lamp has started, gradually increasing the electric power supplied to the magnetron to the maximum value.

4. The soft-staring method as set forth in claim 3, wherein an amount of time elapsing between said applying step and a time at which the electric power supplied to the magnetron reaches the maximum value is approximately 5 to 20 seconds.

5. The soft-staring method as set forth in claim 3, wherein an amount of time elapsing between said applying step and a time at which the electric power supplied to the magnetron reaches the maximum value is 5 seconds.

6. The soft-starting method as set forth in claim 3, further comprising completely vaporizing the emission element before said step of gradually increasing the electric power supplied to the magnetron to a maximum value.

7. The soft-starting method as set forth in claim 6, wherein an amount of time elapsing between said applying step and a time at which the electric power supplied to the magnetron reaches the maximum value is approximately 5 to 20 seconds.

8. The soft-staring method as set forth in claim 6, wherein an amount of time elapsing between said applying step and a time at which the electric power supplied to the magnetron reaches the maximum value is 5 seconds.

9. A soft-starting method for operating an electrodeless lamp system, the electrodeless lamp system comprising a magnetron and an electrodeless lamp, the electrodeless lamp comprising an emission element, said soft-starting method comprising:

applying a sufficient amount of electric power to the magnetron to drive the magnetron and irradiate a microwave comprising an electromagnetic field from the magnetron, the microwave having an energy less than a maximum value;

exciting the emission element of the electrodeless lamp with the electromagnetic field, said exciting comprising absorbing the microwave and vaporizing the emission element to start the emission of light from the electrodeless lamp;

gradually increasing the electric power supplied to the magnetron; and detecting a luminous flux density of the light irradiated from the electrodeless lamp for controlling the gradual increase of electric power supplied to the magnetron, said controlling comprising when the luminous flux density detected is less than a predetermined value, stopping the gradual increase of the electric power supplied to the magnetron for maintaining a waiting condition; and when the luminous flux density detected reaches the predetermined value, restarting the gradual increase of the electric power to the magnetron.

10. The soft-starting method as set forth in claim 9, wherein said gradually increasing of the electric power supplied to the magnetron is started after light is emitted from the electrodeless lamp.

11. The soft-starting method as set forth in claim 9, wherein said gradually increasing of the electric power supplied to the magnetron comprises increasing the electric power to the maximum value.

* * * * *